US010767123B2

(12) United States Patent
Guillevic et al.

(10) Patent No.: US 10,767,123 B2
(45) Date of Patent: Sep. 8, 2020

(54) COIL-WOUND HEAT EXCHANGER FOR HYDROTREATMENT OR HYDROCONVERSION

(71) Applicant: AXENS, Rueil Malmaison (FR)

(72) Inventors: Marion Guillevic, Issy les Moulineaux (FR); Virginie Gobert, Rueil-Malmaison (FR); Jacinthe Frecon, Rueil-Malmaison (FR); Odile Lajeunesse, Rueil-Malmaison (FR)

(73) Assignee: AXENS, Rueil Malmaison (FR)

( * ) Notice: Subject to any disclaimer, the term of this patent is extended or adjusted under 35 U.S.C. 154(b) by 0 days.

(21) Appl. No.: 16/228,967

(22) Filed: Dec. 21, 2018

(65) Prior Publication Data

US 2019/0194557 A1 Jun. 27, 2019

(30) Foreign Application Priority Data

Dec. 22, 2017 (FR) ..... 17 62992

(51) Int. Cl.
*C10G 65/12* (2006.01)
*C10G 47/00* (2006.01)
(Continued)

(52) U.S. Cl.
CPC ..... *C10G 65/12* (2013.01); *C10G 45/00* (2013.01); *C10G 47/00* (2013.01); *C10G 49/00* (2013.01);
(Continued)

(58) Field of Classification Search
CPC ..... C10G 45/00; C10G 45/22; C10G 47/00; C10G 49/00; C10G 67/02; B01J 19/0013; F28D 7/024
See application file for complete search history.

(56) References Cited

U.S. PATENT DOCUMENTS 1,949,632 A 3/1934 Russell
2011/0174687 A1* 7/2011 Reynolds ..... B01J 27/04 208/100
(Continued)

FOREIGN PATENT DOCUMENTS

EP 3184607 B1 12/2018
GB 348690 A 5/1931
(Continued)

OTHER PUBLICATIONS

Chen, Y.D. et al. (2015) Procedia Engineering, 130, 286-297.*
Search report in corresponding FR 1762992 dated Jun. 14, 2018 (8 Pages).

*Primary Examiner* — Brian A McCaig
(74) *Attorney, Agent, or Firm* — Millen, White, Zelano and Branigan, P.C.

(57) ABSTRACT

The present invention relates to a device and a process for hydroconversion or hydrotreatment of a hydrocarbon feedstock, comprising in particular a single coil-wound heat exchanger (S-1), said coil-wound exchanger being a single-pass heat exchanger formed by a vertical chamber in which one or more bundles of tubes are helically wound around a central core, as numerous superposed layers, for: preheating a hydrocarbon feedstock/hydrogen stream mixture to a reactor inlet furnace (F-1) of a hydrotreatment or hydroconversion reaction section (R-1), and cooling the reaction effluent from the hydrotreatment or hydroconversion reaction section (R-1). The present invention also relates to a use of a coil-wound heat exchanger (S-1) in a process for hydroconversion or hydrotreatment of a hydrocarbon feedstock.

14 Claims, 3 Drawing Sheets

(51) Int. Cl.

| | |
|---|---|
| ***C10G 45/00*** | (2006.01) |
| ***C10G 49/00*** | (2006.01) |
| ***F28D 7/02*** | (2006.01) |
| *C10G 11/18* | (2006.01) |
| *C10G 21/14* | (2006.01) |
| *C10G 55/06* | (2006.01) |
| *F25J 1/00* | (2006.01) |

(52) U.S. Cl.

CPC ..... *F28D 7/024* (2013.01); *C10G 11/18* (2013.01); *C10G 21/14* (2013.01); *C10G 55/06* (2013.01); *C10G 2300/107* (2013.01); *C10G 2300/1033* (2013.01); *C10G 2300/1077* (2013.01); *F25J 1/0022* (2013.01); *F25J 1/0052* (2013.01); *F25J 2220/64* (2013.01)

(56) References Cited

U.S. PATENT DOCUMENTS

| | | | | |
|---|---|---|---|---|
| 2011/0272123 | A1 | 11/2011 | Avis | |
| 2015/0198373 | A1* | 7/2015 | Zhang | F28F 9/02 165/154 |
| 2017/0183574 | A1 | 6/2017 | Odile | |
| 2018/0187101 | A1* | 7/2018 | Pupat | C10G 49/22 |

FOREIGN PATENT DOCUMENTS

| | | | |
|---|---|---|---|
| GB | 360530 | A | 11/1931 |
| GB | 377938 | A | 8/1932 |
| WO | 2011002429 | A1 | 1/2011 |

* cited by examiner

COIL-WOUND HEAT EXCHANGER FOR HYDROTREATMENT OR HYDROCONVERSION

TECHNICAL FIELD

The present description relates to the field of devices and processes for hydroconversion (e.g. hydrocracking of heavy feedstocks) and hydrotreatment (e.g. hydrodemetallization, hydrodenitrogenation and/or hydrodesulfurization of residue or of gas oil).

PRIOR ART

Shell and tube heat exchangers have been known for a long time. U.S. Pat. No. 2,978,226, EP 1 113 238 and EP 2 975 353 describe examples of heat exchangers of this type. Well-known shell and tube heat exchangers are for example the heat exchanges of the BEU or DEU standard which comprises bundles of exchange tubes in a U-shape (U-tube bundle). These standards are defined by the Tubular Exchanger Manufactures Association (TEMA; www-.tema.org).

Coil-wound heat exchangers, also referred to as spiral-wound heat exchangers, are known to a person skilled in the art. Thus, patent EP 1367350 describes a coil-wound heat exchanger and the use thereof in an LNG liquefaction process. Other configurations of coil-wound heat exchangers are for example described in patent applications WO 2004/063655 and WO 2014/067223.

The use of coil-wound heat exchangers has been envisaged, in the same way as other heat exchangers, in various processes such as for example processes for converting heavy feedstocks (U.S. Pat. Nos. 8,152,994 and 8,277,637) or cryogenic air separation processes (U.S. Pat. No. 6,718,79), without however this use leading to a modification of the layout compared to the case where other types of heat exchanger (shell and tube or plate heat exchangers for example) are used.

SUMMARY

Within the context described above, a first objective of the present description is to improve the hydroconversion or hydrotreatment devices and processes, especially in terms of energy efficiency and operating cost.

According to a first aspect, the aforementioned objective, and also other advantages, are obtained by a device for hydroconversion or hydrotreatment of a hydrocarbon feedstock, comprising:

- a single coil-wound heat exchanger, said coil-wound exchanger being a single-pass heat exchanger formed by a vertical chamber in which one or more bundles of tubes are helically wound around a central core, as numerous superposed layers, suitable for:
  - preheating and directly distributing the hydrocarbon feedstock and optionally a hydrogen stream or a hydrocarbon feedstock/hydrogen stream mixture to a reactor inlet furnace of a hydrotreatment or hydroconversion reaction section, and cooling the reaction effluent from the hydrotreatment or hydroconversion reaction section;
- a first mixing section suitable for mixing the hydrocarbon feedstock with the hydrogen stream, it being possible for said first mixing section to lie upstream or downstream of the coil-wound heat exchanger;

- the reactor inlet furnace for heating and distributing the preheated hydrocarbon feedstock/hydrogen stream mixture to the hydrotreatment or hydroconversion reaction section;
- the hydrotreatment or hydroconversion reaction section suitable for hydrotreating or hydroconverting the hydrocarbon feedstock;
- a high-pressure cold separator suitable for separating at least one portion of the cooled reaction effluent into a first liquid effluent comprising at least one light fraction and a first gaseous effluent comprising hydrogen; and
- a separation column suitable for separating the first liquid effluent comprising at least one light fraction into a bottoms liquid and an overhead effluent.

According to one or more embodiments, the device further comprises a first compression section suitable for compressing and recycling the first gaseous effluent comprising hydrogen to the first mixing section or the coil-wound heat exchanger.

According to one or more embodiments, the hydrotreatment or hydroconversion reaction section comprises at least one reactor comprising at least one catalyst comprising at least one element chosen from elements from Group VIII of the Periodic Table.

According to one or more embodiments, the reactor comprises at least one fixed bed.

According to one or more embodiments, the reactor comprises at least one bubbling bed.

According to one or more embodiments, the device comprises a device for filtering the hydrocarbon feedstock at the inlet of the unit. According to one or more embodiments, the filtration device is located downstream of an optional heat exchanger suitable for heating the hydrocarbon feedstock to a temperature between 50° C. and 100° C. or between 150° C. and 230° C.

According to one or more embodiments, the device comprises a feedstock drum suitable for containing the optionally filtered hydrocarbon feedstock. Said drum being located upstream of a pump for feeding the coil-wound heat exchanger S-1.

According to one or more embodiments, the device further comprises a first bypass suitable for directly distributing a portion of the hydrocarbon feedstock or a portion of the hydrocarbon feedstock/hydrogen stream mixture from the inlet of the coil-wound heat exchanger to the outlet of the coil-wound heat exchanger.

According to one or more embodiments, the coil-wound heat exchanger is a multiservice coil-wound heat exchanger (i.e., suitable for cooling/heating additional fluids).

According to one or more embodiments, the multiservice coil-wound heat exchanger is suitable for heating at least one portion of the bottoms liquid from the separation column.

According to one or more embodiments, the device further comprises a second bypass of the multiservice coil-wound heat exchanger suitable for controlling the temperature of the bottoms liquid at the outlet of the multiservice coil-wound heat exchanger.

According to one or more embodiments, the device further comprises a high-pressure hot separator suitable for separating the cooled reaction effluent into a first liquid effluent comprising at least one heavy fraction and a first gaseous effluent comprising a light fraction distributed to the high-pressure cold separator.

According to one or more embodiments, the device further comprises a medium-pressure hot separator suitable for separating the first liquid effluent comprising at least one heavy fraction into a second liquid effluent comprising at least one heavy fraction distributed to the separation column, and a second gaseous effluent comprising a light fraction.

According to one or more embodiments, the device further comprises a medium-pressure cold separator suitable for separating the first liquid effluent comprising at least one light fraction into a second liquid effluent comprising at least one light fraction distributed to the separation column, and a second gaseous effluent comprising hydrogen.

According to one or more embodiments, the medium-pressure cold separator is suitable for separating the second gaseous effluent comprising a light fraction.

According to one or more embodiments, the hydrotreatment or hydroconversion reaction section is suitable for directly distributing the reaction effluent to the coil-wound heat exchanger.

According to one or more embodiments, the device further comprises at least a second heat exchanger and/or a steam generator and/or a first air condenser which are suitable for cooling and/or condensing the first gaseous effluent comprising a light fraction, respectively.

According to one or more embodiments, the device further comprises an amine washing column suitable for eliminating at least a portion of the $H_2S$ from the first gaseous effluent comprising hydrogen.

According to one or more embodiments, the device further comprises a second air condenser suitable for condensing the second gaseous effluent comprising a light fraction and distributing the condensed second gaseous effluent comprising a light fraction to the medium-pressure cold separator.

According to one or more embodiments, the device further comprises a third heat exchanger suitable for heating the first or second liquid effluent comprising at least one light fraction.

According to one or more embodiments, the device further comprises a fourth heat exchanger suitable for heating the bottoms liquid from the separation column.

According to one or more embodiments, the device further comprises a second furnace suitable for heating the bottoms liquid from the separation column and distributing it to a fractionating column.

According to one or more embodiments, the device further comprises a fifth heat exchanger suitable for cooling or heating the first or second liquid effluent comprising at least one heavy fraction.

According to one or more embodiments, the device further comprises a third air condenser suitable for condensing the overhead effluent from the separation column.

According to one or more embodiments, the device further comprises a reflux drum suitable for separating the overhead effluent from the separation column into an overhead gaseous fraction and at least one hydrocarbon liquid cut.

According to a second aspect, the aforementioned objective, and also other advantages, are obtained by a process for hydroconversion or hydrotreatment of a hydrocarbon feedstock, comprising the following steps:

preheating and directly distributing the hydrocarbon feedstock and optionally a hydrogen stream or a hydrocarbon feedstock/hydrogen stream mixture to a reactor inlet furnace of a hydrotreatment or hydroconversion reaction section by means of a single coil-wound heat exchanger, said coil-wound exchanger being a single-pass heat exchanger formed by a vertical chamber in which one or more bundles of tubes are helically wound around a central core, as numerous superposed layers;

mixing the hydrocarbon feedstock with the hydrogen stream in a first mixing section, it being possible for said mixing to take place before or after the preheating step;

cooling the reaction effluent from the hydrotreatment or hydroconversion reaction section by means of the coil-wound heat exchanger;

heating and distributing the preheated hydrocarbon feedstock/hydrogen stream mixture to the hydrotreatment or hydroconversion reaction section by means of the reactor inlet furnace;

hydrotreating or hydroconverting the hydrocarbon feedstock in the hydrotreatment or hydroconversion reaction section comprising at least one reactor comprising at least one catalyst comprising at least one element chosen from elements from Group VIII of the Periodic Table;

separating at least one portion of the cooled reaction effluent in a high-pressure cold separator in order to distribute a first liquid effluent comprising at least one light fraction and a first gaseous effluent comprising hydrogen; and separating the first liquid effluent comprising at least one light fraction in a separation column in order to distribute a bottoms liquid and an overhead effluent.

According to one or more embodiments, the process further comprises compressing and recycling the first gaseous effluent comprising hydrogen to the first mixing section or the coil-wound heat exchanger by means of a first compression section.

According to one or more embodiments, the hydrotreatment or hydroconversion of the hydrocarbon feedstock is carried out under hydrotreatment or hydroconversion conditions, such as at least one of the following operating conditions:

the temperature is between around 200° C. and around 460° C.;

the total pressure is between around 1 MPa and around 20 MPa;

the overall hourly space velocity of liquid feedstock is between around 0.05 $h^{-1}$ and around 12 $h^{-1}$;

the hydrogen stream comprises between around 50 vol % and around 100 vol % of hydrogen relative to the volume of the hydrogen stream;

the amount of hydrogen relative to the liquid hydrocarbon feedstock is between around 50 $Nm^3/m^3$ and around 2500 $Nm^3/m^3$.

According to one or more embodiments, the initial boiling point of the hydrocarbon feedstock is above 120° C. For example, the hydrocarbon feedstock may be chosen from the following feedstocks: atmospheric distillates, vacuum distillates, atmospheric or vacuum residues or effluents from a Fischer-Tropsch unit. Preferably, the hydrocarbon feedstock is chosen from the following feedstocks: atmospheric distillate (naphtha, petroleum, kerosene and gas oils), vacuum distillate, for example gas oils, resulting from the direct distillation of the crude oil or from conversion unit such as an FCC (fluid catalytic cracking unit), a coker or a visbreaking unit, LCO (light cycle oil) resulting from a catalytic cracking unit, feedstocks originating from units for extracting aromatics, lubricating oil bases or bases resulting from solvent dewaxing of a lubricating oil bases, distillates originating from fixed-bed or bubbling-bed processes for the desulphurisation or hydroconversion of ATRs (atmospheric residues) and/or of VRs (vacuum residues) and/or of deasphalted oils, deasphalted oils, effluents from a Fischer-Tropsch unit, plant oils, alone or as a mixture, or animal fats. The above list is not limiting.

According to one or more embodiments, the high-pressure cold separator is operated at a pressure below the pressure of the hydrotreatment or hydroconversion reaction section.

According to one or more embodiments, the temperature of the high-pressure cold separator is between 20° C. and 100° C.

According to one or more embodiments, the high-pressure hot separator is operated at a pressure below the pressure of the hydrotreatment or hydroconversion reaction section.

According to one or more embodiments, the temperature of the high-pressure hot separator is between 200° C. and 450° C.

According to one or more embodiments, the hydrocarbon feedstock is at a temperature of between 30° C. and 110° C., preferentially between 34° C. and 100° C., at the inlet of the unit.

According to one or more embodiments, the hydrocarbon feedstock is at a temperature of between 150° C. and 280° C., preferentially between 160° C. and 260° C., at the inlet of the unit.

According to one or more embodiments, the process comprises a step of filtering the hydrocarbon feedstock at the inlet of the unit, optionally after a step of heating to a temperature of between 50° C. and 100° C. or between 150° C. and 230° C. According to one or more embodiments, the process comprises a step of retaining the filtered hydrocarbon feedstock in a feedstock drum. A step of pumping said feedstock from the drum makes possible to feed the coil-wound heat exchanger S-1.

According to one or more embodiments, the temperature of the hydrocarbon feedstock and optionally of the hydrogen stream or of the hydrocarbon feedstock/hydrogen stream mixture at the outlet of the mixing section (located upstream of the coil-wound heat exchanger) and/or at the inlet of the coil-wound heat exchanger and/or at the inlet of the first bypass is between 30° C. and 280° C., preferably between 34° C. and 260° C. According to one or more particularly preferred embodiments, the abovementioned temperature is between 40° C. and 60° C. (cold scheme). According to one or more particularly preferred embodiments, the abovementioned temperature is between 200° C. and 250° C. (hot scheme).

According to one or more embodiments, the temperature of the preheated hydrocarbon feedstock/hydrogen stream mixture at the outlet of the coil-wound heat exchanger is between 200° C. and 450° C., preferably between 230° C. and 430° C.

According to one or more embodiments, the temperature of the preheated hydrocarbon feedstock/hydrogen stream mixture at the inlet of the reactor inlet furnace is between 200° C. and 450° C., preferably between 230° C. and 430° C.

According to one or more embodiments, the temperature of the heated hydrocarbon feedstock/hydrogen stream mixture at the outlet of the reactor inlet furnace and/or at the inlet of the hydrotreatment or hydroconversion reaction section is between 210° C. and 460° C., preferably between 240° C. and 440° C.

According to one or more embodiments, the temperature of the reaction effluent at the outlet of the hydrotreatment or hydroconversion reaction section and/or at the inlet of the coil-wound heat exchanger is between 210° C. and 465° C., preferably between 240° C. and 445° C.

According to one or more embodiments, the temperature of the cooled reaction effluent at the outlet of the coil-wound heat exchanger is between 70° C. and 400° C., preferably between 80° C. and 380° C.

According to one or more embodiments, the coil-wound heat exchanger is a multiservice coil-wound heat exchanger suitable for heating at least one portion of the bottoms liquid from the separation column, and the temperature of the bottoms liquid at the inlet of the multiservice coil-wound heat exchanger is between 200° C. and 250° C., preferably between 200° C. and 240° C.

According to one or more embodiments, the temperature of the bottoms liquid at the outlet of the multiservice coil-wound heat exchanger is between 300° C. and 450° C., preferably between 320° C. and 430° C.

According to a third aspect, the aforementioned objective, and also other advantages, are obtained by a use of a coil-wound heat exchanger, said coil-wound exchanger being a single-pass heat exchanger formed by a vertical chamber in which one or more bundles of tubes are helically wound around a central core, as numerous superposed layers, in a hydrotreatment or hydroconversion process.

According to one or more embodiments, the coil-wound heat exchanger is used for:

preheating and directly distributing a hydrocarbon feedstock/hydrogen stream mixture to a reactor inlet furnace of a hydrotreatment or hydroconversion reaction section; and cooling the effluent from the hydrotreatment or hydroconversion reaction section.

Embodiments of the device, of the process and of the use referred to above and also other features and advantages will become apparent on reading the description that follows, given solely by way of illustration and non-limitingly, and with reference to the following drawings.

DETAILED DESCRIPTION

The present description relates to the field of hydroconversion devices and processes, such as devices and processes for hydrocracking heavy feedstocks, for example vacuum residues or vacuum gas oil. The present description also relates to the field of hydrotreatment devices and processes, such as devices and processes for hydrodemetallization, hydrodenitrogenation and/or hydrodesulfurization of residue or of gas oil.

Figure 1:
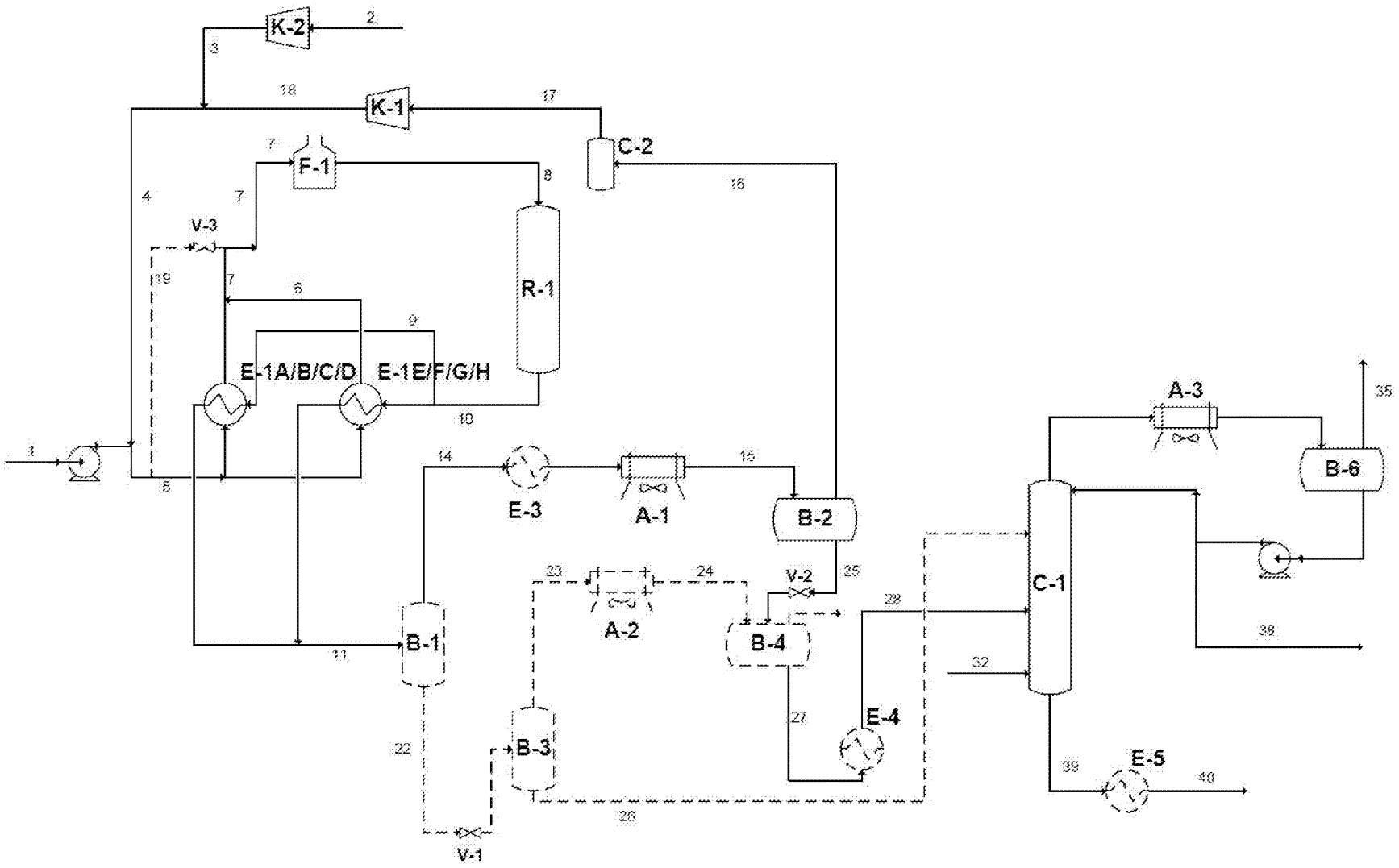
FIG. 1 depicts a layout of a reference device in which the feedstock of the reaction section is preheated by the reaction effluent in two shell and tube heat exchanger trains then heated in a furnace before entering the reaction section.

With reference to FIG. 1, a reference device for hydrotreatment or hydroconversion of hydrocarbon feedstocks, such as gas oils, vacuum distillates, atmospheric or vacuum residues or effluents from a Fischer-Tropsch unit, comprises:

- a first section for mixing the hydrocarbon feedstock (line 1) and a hydrogen stream (line 4);
- several trains of shell and tube heat exchangers E-1A/B/C/D and E-1E/F/G/H for preheating the hydrocarbon feedstock/hydrogen stream mixture (referred to hereinafter as hydrocarbon mixture) (line 5) resulting from the first mixing section with the reaction effluent (line 9) from a hydrotreatment or hydroconversion reaction section R-1;
- a reactor inlet furnace F-1 for heating the preheated hydrocarbon mixture (line 7) resulting from the trains of shell and tube heat exchangers E-1 and distributing the heated hydrocarbon mixture (line 8) to the hydrotreatment or hydroconversion reaction section R-1;
- the hydrotreatment or hydroconversion reaction section R-1;
- optionally a first bypass (bypass line 19) so that a portion of the hydrocarbon mixture (line 5) can avoid the trains of shell and tube heat exchangers E-1 and enable the reaction temperature of the hydrotreatment or hydroconversion reaction section R-1 to be adjusted;
- optionally, a high-pressure hot separator B-1, the feedstock of which is formed by the reaction effluent cooled after passing through the trains of shell and tube heat exchangers E-1 (line 11), in order to distribute a first liquid effluent comprising at least one heavy fraction (line 22) and a first gaseous effluent comprising a light fraction (line 14);
- a high-pressure cold separator B-2, the feedstock of which is formed by at least one portion of the reaction effluent resulting from the hydrotreatment or hydroconversion reaction section R-1 and cooled after passing through the trains of shell and tube heat exchangers E-1 (lines 11 and 14), in order to distribute a first liquid effluent comprising at least one light fraction (line 25) and a first gaseous effluent comprising hydrogen (line 16);
- optionally a second heat exchanger E-3 for cooling the at least one portion of the reaction effluent (or optionally the first gaseous effluent comprising a light fraction originating from the high-pressure hot separator B-1);
- optionally a first air condenser A-1 for condensing the at least one portion of the reaction effluent (or optionally the first gaseous effluent comprising a light fraction originating from the high-pressure hot separator B-1 and optionally further originating from the second heat exchanger E-3);
- optionally an amine washing column C-2 that makes it possible to eliminate at least a portion of the $H_2S$ from the first gaseous effluent comprising hydrogen (line 16) resulting from the high-pressure cold separator B-2, also referred to as recycled hydrogen;
- optionally a first compression section K-1 for compressing the recycled and amine-washed hydrogen (line 17);
- optionally a second compression section K-2 for compressing the make-up hydrogen (line 2);
- optionally a second section for mixing the recycled, washed and compressed hydrogen (line 18) and the compressed make-up hydrogen (line 3);
- optionally a medium-pressure hot separator B-3, the feedstock of which is the first liquid effluent comprising at least one heavy fraction (line 22) resulting from the high-pressure hot separator B-1, and one effluent of which is a second liquid effluent comprising at least one heavy fraction (line 26) which is distributed to a separation column C-1;
- optionally a second air condenser A-2 for condensing a second gaseous effluent comprising a light fraction (line 23) resulting from the medium-pressure hot separator B-3 and distributing a condensed second gaseous effluent comprising a light fraction (line 24);
- optionally a medium-pressure cold separator B-4, for separating the first liquid effluent comprising at least one light fraction (line 25) resulting from the high-pressure cold separator B-2 (and optionally the second gaseous effluent comprising a light fraction (line 23) resulting from the medium-pressure hot separator B-3 (and optionally condensed (line 24) in the second air condenser A-2)), distributing a second liquid effluent comprising at least one light fraction (lines 27 and 28) to the separation column C-1, and removing a second gaseous effluent comprising hydrogen;
- the separation column C-1 (e.g. conventional fractionating column or stripping column using a fluid added via the line 32) for distributing a bottoms liquid (line 39) and an overhead effluent starting from the liquid effluent (line 25) resulting from the high-pressure cold separator B-2, optionally resulting from the high-pressure hot separator B-1 (line 22), optionally resulting from the medium-pressure separator B-3 (line 26), optionally resulting from the medium-pressure cold separator B-4 (line 27);
- optionally a third heat exchanger E-4 for heating the feedstock of the separation column C-1 (line 25, optionally line 27);
- optionally a fourth heat exchanger E-5 for heating the bottoms liquid from the separation column C-1 (line 39);
- optionally a second furnace (not represented) suitable for heating the bottoms liquid from the separation column (e.g. after passing through the fourth heat exchanger E-5) and distributing it to a fractionating column (not represented);
- optionally a fifth heat exchanger (not represented) suitable for cooling or heating the first or second liquid effluent comprising at least one heavy fraction;
- optionally a third air condenser A-3 for condensing the overhead effluent resulting from the separation column C-1; and
- optionally a reflux drum B-6 for separating the overhead effluent into a gaseous overhead fraction (e.g. sour gas) (line 35) and a hydrocarbon liquid cut (e.g. naphtha) (line 38).

Figure 2:
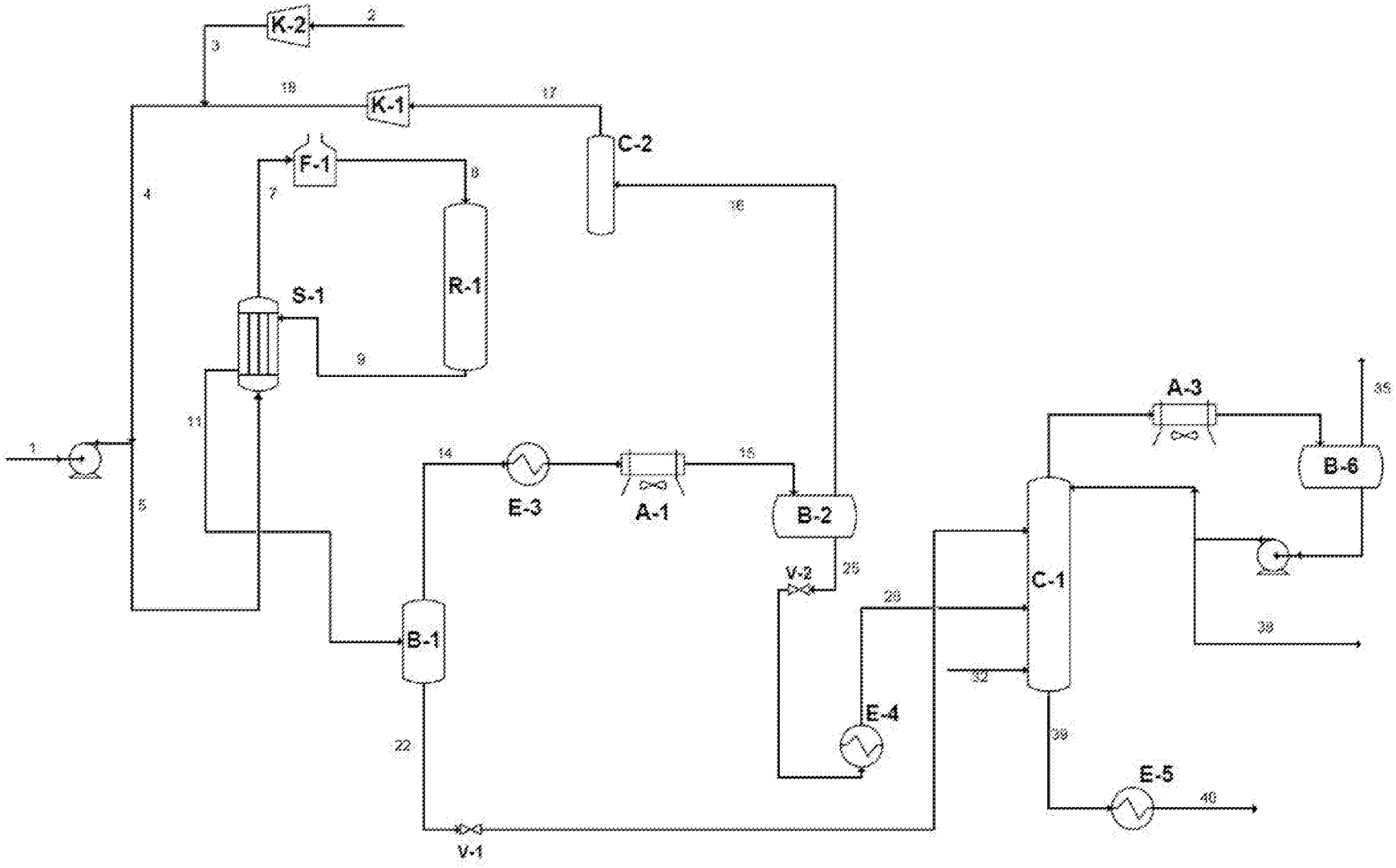
FIG. 2 depicts a layout of a device according to the present description in which the feedstock of the reaction section is preheated by the reaction effluent in a coil-wound heat exchanger S-1 then directly heated in a furnace before entering the reaction section.

FIGS. 1 and 2 have the same numbering for the same equipment of the hydrotreatment or hydroconversion device.

With reference to FIG. 2, the device according to the first aspect of the present description comprises the elements of the reference device, with the exception of the trains of shell and tube heat exchangers E-1 (FIG. 1) which are replaced by a single coil-wound heat exchanger S-1. Specifically, we have demonstrated that a hydrotreatment or hydroconversion device comprising a single coil-wound heat exchanger S-1, as a replacement for the trains of shell and tube heat exchangers E-1, makes it possible in particular to preheat the hydrocarbon mixture to a higher temperature so that the required power of the reactor inlet furnace F-1 is lower.

Furthermore, the coil-wound heat exchanger S-1 is suitable for carrying out one or more additional or exchange surfaces such as the heating of the bottoms effluents resulting from the column C-1 before distributing the bottoms effluent heated in this way to another optional fractionating section (not represented) make it possible in particular to separate this effluent in order to obtain the products one or more of the following products: naphtha (optionally light naphtha and heavy naphtha), kerosene, gas oil and residue. The heating of the feedstock of the separation column C-1 or the heating of the hydrogen when the mixing with the hydrocarbon feedstock takes place downstream of the coil-wound heat exchanger are other examples of additional exchange services, this list not being exhaustive.

The coil-wound heat exchanger S-1 is a single-pass heat exchanger formed by a vertical chamber in which one or more bundles of tubes are helically wound around a central core, as numerous superposed layers (see Technique de l'Ingénieur, J 3 601 V2 paragraph 4.2). Said exchanger makes it possible to exchange heat between a fluid circulating in the chamber and at least one fluid circulating in the tube bundle.

According to one or more embodiments, the coil-wound heat exchanger S-1 is used with the hot fluid on the shell side and the cold fluid on the tube side.

According to one or more embodiments, the coil-wound heat exchanger S-1 is used with the hot fluid on the tube side and the cold fluid on the shell side.

According to one or more embodiments, when the coil-wound heat exchanger S-1 is suitable for carrying out one or more additional exchange services, the additional exchange service(s) is (are) carried out on the tube side, by distributing the various services in the tubes of the bundle of tubes without there being mixing of the various services and by distributing and collecting the various services separately.

In the example from FIG. 2, the first mixing section is positioned upstream of the coil-wound heat exchanger S-1. In one or more embodiments, the first mixing section lies downstream of the coil-wound heat exchanger S-1.

In the example from FIG. 2, the coil-wound heat exchanger (S-1) is positioned to preheat the hydrocarbon feedstock/hydrogen stream mixture. On the other hand, the coil-wound heat exchanger (S-1) may be configured to preheat the hydrocarbon feedstock alone and optionally the hydrogen stream as an additional heat exchange service.

According to one or more embodiments, the initial boiling point of the hydrocarbon feedstock is greater than 120° C. In the case of diesel, the initial point is generally around 150° C. and the distillation range is typically between 170° C. and 390° C. In the case of atmospheric residue, the initial point is typically greater than 300° C., preferably between 340° C. and 380° C. In the case of vacuum residue, the initial point is typically between 450° C. and 600° C., preferably between 500° C. and 550° C. Light vacuum distillate (light vacuum gas oil—LVGO) is characterized by a distillation range between 300° C. and 430° C., preferably between 340° C. and 400° C. Heavy vacuum distillate (heavy vacuum gas oil—HVGO) is characterized by a distillation range between 400° C. and 620° C., preferably between 440° C. and 550° C. The usable feedstocks are therefore in a wide range of boiling points.

According to one or more embodiments, the hydrocarbon feedstock contains at least 10% by volume, generally at least 20% by volume, an often at least 80% by volume of compounds that boil above 340° C.

According to one or more embodiments, the nitrogen content of the hydrocarbon feedstock is greater than 500 ppm by weight, generally between 500 and 10 000 ppm by weight, more generally between 700 and 4500 ppm by weight and more generally still between 800 and 4500 ppm by weight.

According to one or more embodiments, the sulfur content of the hydrocarbon feedstock is between 0.01% and 5% by weight, generally between 0.2% and 4% by weight and more generally still between 0.5% and 3% by weight.

According to one or more embodiments, the hydrocarbon feedstock contains metals.

According to one or more embodiments, the combined nickel and vanadium content of the hydrocarbon feedstock is less than 10 ppm by weight, preferably less than 5 ppm by weight and more preferably still less than 2 ppm by weight.

According to one or more embodiments, the asphaltene content of the hydrocarbon feedstock is less than 3000 ppm by weight, preferably less than 1000 ppm by weight and more preferably still less than 300 ppm by weight.

According to one or more embodiments, the reaction effluent from the hydrotreatment or hydroconversion reaction section R-1 consists of a hydrocarbon cut, generally as a mixed phase, comprising hydrogen, gases resulting from the cracking, and in particular $H_2S$ and $NH_3$ resulting from the reactions of said reaction section, in proportion to the content of sulfur and nitrogen contained in the feedstock, optionally $CO_2$ and other gases, light cuts such as LPG (liquefied petroleum gas) originating from secondary reactions, and at least naphtha, and optionally the following hydrocarbon cuts: diesel, kerosene and/or unconverted residue, etc., depending on the nature of the feedstock and on the type of reaction.

According to one or more embodiments, the first liquid effluent comprising at least one heavy fraction comprises at least one portion of the heaviest fraction of the effluent from the reaction section, comprising naphtha, diesel, kerosene and/or unconverted residue depending on the nature of the feedstock and on the type of reaction. The first liquid effluent comprising at least one heavy fraction may also comprise an intermediate fraction of the effluent from the reaction section, optionally comprising diesel, kerosene and/or naphtha depending on the nature of the feedstock and on the type of reaction.

According to one or more embodiments, the first gaseous effluent comprising a light fraction comprises at least one portion of the lightest fraction of the reaction effluent, comprising hydrogen, gases resulting from the cracking, and in particular $H_2S$ and $NH_3$ resulting from the reactions of the reaction section, in proportion to the content of sulfur and nitrogen contained in the feedstock, optionally $CO_2$ and other gases, light cuts such as LPG originating from secondary reactions, and at least naphtha.

According to one or more embodiments, the first liquid effluent comprising at least one light fraction comprises a fraction of the reaction effluent comprising light cuts such as LPG originating from secondary reactions, and at least naphtha.

According to one or more embodiments, the first gaseous effluent comprising hydrogen comprises gases resulting from the cracking, and in particular $H_2S$ resulting from the reactions of the reaction section, in proportion to the content of sulfur contained in the feedstock, optionally $CO_2$.

According to one or more embodiments, the second liquid effluent comprising at least one heavy fraction comprises the heaviest fraction of the effluent from the reaction section, comprising diesel, kerosene and/or unconverted residue depending on the nature of the feedstock and on the type of reaction.

According to one or more embodiments, the second gaseous effluent comprising a light fraction comprises a first intermediate fraction of the effluent from the reaction section, optionally comprising diesel, kerosene and/or naphtha depending on the nature of the feedstock and on the type of reaction.

According to one or more embodiments, the second liquid effluent comprising at least one light fraction comprises the heaviest fraction of the first liquid effluent comprising at least one light fraction. The second liquid effluent comprising at least one light fraction may also comprise a second intermediate fraction of the effluent from the reaction section, comprising diesel, kerosene and/or naphtha depending on the nature of the feedstock and on the type of reaction.

According to one or more embodiments, the second gaseous effluent comprising hydrogen comprises at least one portion of the lightest fraction of the reaction effluent, comprising hydrogen, gases resulting from the cracking, and in particular $H_2S$ resulting from the reactions of the reaction section, in proportion to the content of sulfur contained in the feedstock, optionally $CO_2$ and other gases.

According to one or more embodiments, the overhead effluent comprises gases resulting from the cracking, and in particular $H_2S$, optionally $CO_2$ and other gases, LPGs, naphtha and optionally the stripping fluid.

According to one or more embodiments, the gaseous overhead fraction comprises gases resulting from the cracking, and in particular $H_2S$, optionally $CO_2$ and other gases, LPGs.

According to one or more embodiments, the liquid hydrocarbon cut comprises naphtha.

According to one or more embodiments, the bottoms liquid comprises the heaviest fraction of the effluent from the reaction section, comprising diesel, kerosene and/or unconverted residue depending on the nature of the feedstock and on the type of reaction.

In the device according to the present description, the hydrotreatment or hydroconversion reaction section R-1 may comprise one or more reactors arranged in series or in parallel, for example two reactors arranged in series. Each reactor of the reaction section comprises at least one catalyst bed. The catalyst may be used in a fixed bed, or in an expanded bed, or else in a bubbling bed. In the case of a catalyst used in a fixed bed, it is possible to position several catalyst beds in at least one reactor. Each reactor may be equipped with cooling means such as, for example, a liquid or gaseous quench stream located between two successive beds so as to control the temperature at the inlet of each of the beds in the reactor. On the other hand, the hydrotreatment or hydroconversion reactors are free of heating means.

According to one or more embodiments, the hydrotreatment or hydroconversion reaction section R-1 is the reaction section of a hydrocracking unit.

According to one or more embodiments, the hydrotreatment or hydroconversion reaction section R-1 is the reaction section of a unit for hydrodesulfurization of diesel or kerosene or vacuum distillate.

According to one or more embodiments, the hydrotreatment or hydroconversion reaction section R-1 is the reaction section of a unit for hydrodesulfurization of naphtha.

According to one or more embodiments, the hydrotreatment or hydroconversion reaction section R-1 is included in a unit for hydroconversion of residue or distillate or deasphalted oil in a bubbling bed.

The separation column C-1 aims in particular to eliminate the gases resulting from cracking (generally referred to as sour gases), and in particular $H_2S$ resulting from the reactions of the reaction section. This column is preferably stripped by means of any stripping gas such as for example a gas containing hydrogen or steam. Preferably steam is used to carry out said stripping.

According to the second aspect, the present description also relates to a process for implementing the device according to the first aspect.

According to one or more embodiments, the operating conditions of the hydrotreatment or hydroconversion reaction section R-1 comprise at least one of the following features:

- the temperature is between around 200° C. and around 460° C., preferentially between around 240° C. and around 445° C.;
- the total pressure is between around 1 and around 20 MPa, such as between 2 and 20 MPa, preferably between 2.5 and 18 MPa, and very preferably between 3 and 18 MPa;
- the overall hourly space velocity of liquid feedstock for each catalytic step is between around 0.05 $h^{-1}$ and around 12 $h^{-1}$, and preferably between around 0.1 $h^{-1}$ and around $101^{-1}$;
- the purity of the hydrogen used is between around 50% and 100% by volume relative to the volume of the hydrogen supply (i.e., recycled hydrogen/make-up hydrogen mixture); and
- the amount of hydrogen relative to the liquid hydrocarbon feedstock is between around 50 $Nm^3/m^3$ and around 2500 $Nm^3/m^3$.

Any catalyst known to a person skilled in the art can be used in the process according to the present description, for example a catalyst comprising at least one element chosen from the elements from Group VIII of the Periodic Table (groups 8, 9 and 10 of the new Periodic Table) and optionally at least one element chosen from the elements from Group VIB of the Periodic Table (group 6 of the new Periodic Table).

Hereinafter, groups of chemical elements are given according to the CAS classification (CRC Handbook of Chemistry and Physics, published by CRC Press, Editor in Chief D. R. Lide, $81^{st}$ edition, 2000-2001). For example, group VIII according to the CAS classification corresponds to the metals from columns 8, 9 and 10 according to the new IUPAC classification; group VIb according to the CAS classification corresponds to the metals from column 6 according to the new IUPAC classification.

For the implementation of the process according to the present description, it is possible to use a conventional hydroconversion catalyst comprising, on an amorphous support, at least one metal or metal compound having a hydrogenating-dehydrogenating function. This catalyst may be a catalyst comprising metals from group VIII, for example nickel and/or cobalt, often in combination with at least one metal from group VIB, for example molybdenum and/or tungsten. Use may, for example, be made of a catalyst comprising from 0.5% to 10% by weight of nickel (expressed as nickel oxide NiO) and from 1% to 30% by weight of molybdenum, preferably from 5% to 20% by weight of molybdenum (expressed as molybdenum oxide $MoO_3$) relative to the total weight of the catalyst, on an amorphous mineral support. The total content of oxides of metals from groups VIB and VIII in the catalyst is generally between 5% and 40% by weight and preferentially between 7% and 30% by weight relative to the total weight of the catalyst. The weight ratio (expressed on the basis of the metal oxides) between metal(s) from group VIB and metal(s) from group VIII is, in general, from around 20 to around 1, and usually from around 10 to around 2. The support is, for example, selected from the group formed by alumina, silica, silica-aluminas, magnesia, clays and mixtures of at least two of these minerals. This support may also contain other compounds and for example oxides chosen from boron oxide, zirconia, titanium oxide, phosphoric anhydride.

Another type of catalyst that can be used is a catalyst containing at least one matrix, at least one Y zeolite and at least one hydrogenating-dehydrogenating metal. The matrices, metals and additional elements described above may also be incorporated in the composition of this catalyst. Advantageous Y zeolites are described in patent application WO 00/71641, and also patents EP 0 911 077, U.S. Pat. Nos. 4,738,940 and 4,738,941.

According to one or more embodiments, the high-pressure cold separator B-2 is operated at a pressure lower than that of the hydrotreatment or hydroconversion reaction section R-1 or of the high-pressure hot separator B-1, for example a pressure 0.1 MPa to 1.0 MPa lower than that of the hydrotreatment or hydroconversion reaction section R-1 or of the high-pressure hot separator B-1.

The temperature of the high-pressure cold separator B-2 is generally as low as possible considering the available cooling means. This is in order to maximize the purity of the recycled hydrogen. The temperature of the high-pressure cold separator B-2 is generally between 20° C. and 100° C., preferably between 35° C. and 70° C. The first liquid effluent comprising at least one light fraction resulting from the high-pressure cold separator B-2 is sent to the separation column C-1, preferably of stripper type, preferably equipped with the reflux drum B-6.

According to one or more embodiments, the cooled reaction effluent is sent to the optional high-pressure hot separator B-1 operated at a lower pressure, for example a pressure 0.1 MPa to 1.0 MPa lower than that of the hydrotreatment or hydroconversion reaction section R-1. The temperature of the high-pressure hot separator B-1 is generally between 200° C. and 450° C., preferably between 250° C. and 380° C. and very preferably between 260° C. and 360° C.

According to one or more embodiments, the first liquid effluent comprising at least one heavy fraction resulting from the high-pressure hot separator B-1 is sent to a first valve V-1 or an optional turbine and sent to the optional medium pressure hot separator B-3, the pressure of which is chosen so as to be able to feed the optional medium-pressure cold separator B-4 with the second liquid effluent comprising at least one heavy fraction resulting from the medium-pressure hot separator B-3.

According to one or more embodiments, the medium-pressure hot separator B-3 is operated at a pressure of between 1.0 and 4.0 MPa, preferably between 1.5 and 3.5 MPa. The temperature of the medium-pressure hot separator B-3 is generally between 150° C. and 380° C., preferably between 200° C. and 360° C.

According to one or more embodiments, the first liquid effluent comprising at least one light fraction resulting from the high-pressure cold separator B-2 is expanded in a second valve V-2 or an optional turbine and sent to the optional medium-pressure cold separator B-4. The total pressure of the medium-pressure cold separator B-4 is preferentially that required to effectively recover the hydrogen within the second gaseous effluent comprising hydrogen separated in said separator B-4. This recovery of hydrogen is preferably carried out in a pressure swing adsorption unit. The total pressure of the medium-pressure cold separator B-4 is generally between 1.0 MPa and 4.0 MPa, preferably between 1.5 MPa and 3.5 MPa. The temperature of the medium-pressure cold separator B-4 is generally between 20° C. and 100° C., preferably between 25° C. and 70° C.

The bottoms liquid (line 39) from the separation column C-1 may be heated by the fourth heat exchanger E-5 before being sent via the line 40 to a fractionating section (not represented) which makes it possible to separate naphtha, kerosene and gas oil cuts and a residue.

According to the third aspect, the present description also relates to a use of the coil-wound heat exchanger S-1 in a device according to the first aspect or a process according to the second aspect, and in particular for preheating and directly distributing the hydrocarbon mixture to the reactor inlet furnace F-1 of the hydrotreatment or hydroconversion reaction section R-1; and cooling the effluent from the hydrotreatment or hydroconversion reaction section R-1.

The device, the process and the use according to the present description have the following advantages:

The two trains of shell and tube exchangers for preheating a hydrocarbon mixture with the reaction effluent are replaced by a single coil-wound exchanger thus making it possible:

- to preheat the feedstock to a higher temperature than that of the reference device and consequently to reduce the required power of the furnace F-1;
- to have only one heat exchanger unlike the reference device which contains at least two trains of heat exchangers and consequently to obtain a saving in terms of investment and occupied floor area; and
- to reduce the pressure drop in the reaction loop and consequently to reduce the power required in the first compression section K-1.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 1762992, filed Dec. 22, 2017 are incorporated by reference herein.

EXAMPLES

Example 1

FIG. 1 constitutes a first reference comparison (comparison 1) and FIG. 2 describes a first example (Example 1) of an embodiment of the device and process according to the present description.

The hydrocarbon feedstock is a cut having a boiling points between 186° C. and 380° C., composed of atmospheric gas oil and atmospheric kerosene having the following characteristics:

| | | |
|---|---|---|
| Specific gravity | | 0.827 |
| Sulfur content | % by weight | 0.7% |
| Nitrogen content | ppm by weight | 67 |

In the present application the specific gravity of the hydrocarbon feedstock is dimensionless.

According to the present description, as represented in FIG. 2, the hydrocarbon feedstock is fed via the line 1. The make-up hydrogen, preferably in excess relative to the hydrocarbon feedstock, is fed via the line 2 and the second compression section K-2 (e.g. compressor) then the line 3, and mixed with the recycled hydrogen in line 4. The hydrogen is then mixed with the hydrocarbon feedstock (line 1) before distributing the hydrocarbon mixture thus obtained to the coil-wound heat exchanger S-1 via the line 5. The coil-wound heat exchanger S-1 makes it possible to preheat the hydrocarbon mixture by means of the reaction effluent. In Example 1, the coil-wound heat exchanger S-1 is as described in patent application WO 2014/067223. After this heat exchange, the preheated hydrocarbon mixture is conveyed via the line 7 to the reactor inlet furnace F-1 in order to be heated and conveyed via the line 8 to a hydrodesulfurization section, formed by at least one hydrodesulfurization reactor (an example of a hydrotreatment or hydroconversion reaction section R-1) comprising at least one hydrodesulfurization catalyst. In Example 1, the temperature of the preheated hydrocarbon mixture does not need to be adjusted by bypassing a portion of the hydrocarbon mixture via the line 19 (optionally by means of a valve V-3).

In Example 1, the hydrotreatment or hydroconversion reaction section R-1 is composed of a hydrodesulfurization reactor with 2 catalyst beds. The beds of the hydrodesulfurization reactor are constituted of Axens HR626 catalyst (of CoMo on $Al_2O_3$ type). The beds are operated approximately at 4.55 MPa and at temperatures between 325° C. and 395° C. The chemical hydrogen consumption in the reaction section is 0.35% by weight relative to the fresh hydrocarbon feedstock.

The reaction effluent is then sent to the coil-wound heat exchanger S-1 via the line 9 then to the high-pressure hot separator B-1 via the line 11.

The first gaseous effluent comprising a light fraction resulting from the high-pressure hot separator B-1 comprises unreacted hydrogen, $H_2S$ formed during the reaction, and also light hydrocarbons resulting from the conversion of the hydrocarbons of the hydrocarbon feedstock in the hydrotreatment reaction section. After cooling in the second exchanger E-3 and the first air condenser A-1 (line 14), the cooled and condensed first gaseous effluent comprising a light fraction is conveyed, via the line 15, to the high-pressure cold separator B-2 making it possible both to carry out a gas-liquid separation and a decantation of an aqueous liquid phase.

The first liquid effluent comprising at least one light fraction resulting from the high-pressure cold separator B-2 feeds the third heat exchanger E-4 via the line 25 and the stripper (an example of a separation column C-1) via the line 28. The stripper C-1 is operated at 0.69 MPa at the top of the column.

The recycled hydrogen resulting from the high-pressure cold separator B-2 is sent via the line 16 to the amine washing column C-2 that makes it possible to eliminate at least one portion of the $H_2S$. The recycled hydrogen is then distributed via the lines 17 and 18 to the first mixing section then to the hydrodesulfurization reactor with the hydrocarbon feedstock, after compression by means of the first compression section K-1 and mixing with the feedstock (line 1).

The stripper is fed with stripping steam via the line 32. At the top of the stripper, the gaseous fraction of the overhead effluent is recovered (generally referred to as sour gas) via the line 35, and a naphtha-type cut is recovered via the line 38 that has a final boiling point usually greater than 100° C. The bottoms liquid from the stripper, recovered via the line 39, is heated in the fourth heat exchanger E-5 before being sent out of the unit via the line 40, for an optional additional fractionation (not represented) which makes it possible to recover naphtha, kerosene, gas oil cuts and a residue.

Table 1 compares:

- a reference hydrotreatment device and process using two parallel trains of four feedstock/effluent shell and tube heat exchangers E-1 of the TEMA BEU standard (FIG. 1); and
- a hydrotreatment device and process according to the present description using a single coil-wound heat exchanger S-1 (FIG. 2).

The reference process is operated with the same feedstock and the same operating conditions as those described above for Example 1.

TABLE 1

| | Comparison 1 (FIG. 1) | Example 1 (FIG. 2) |
|---|---|---|
| Temperature (° C.) of the hydrocarbon mixture at the inlet of E-1/S-1 (Line 5) | 216 | 228 |
| Temperature (° C.) of the hydrocarbon mixture at the outlet of E-1/S-1 (Line 7) | 364 | 385 |
| Temperature (° C.) of the reaction effluent at the inlet of E-1/S-1 (Line 9) | 395 | 395 |
| Temperature (° C.) of the reaction effluent at the outlet of E-1/S-1 (Line 11) | 270 | 270 |
| Power (MW) of the reactor inlet furnace F-1 | 14.1 | 9.6 |
| Power (MW) of the first air condenser A-1 | 9.2 | 9.1 |
| Total power (MW) of the reactor inlet furnace and of the first air condenser | 23.3 | 18.7 |
| Power (kW) of the first compression section K-1 | 2430 | 2030 |

As demonstrated in Table 1, in the device and process according to the present description:

- a single coil-wound heat exchanger S-1 makes it possible to preheat the hydrocarbon mixture to a higher temperature compared to several trains of shell and tube heat exchangers E-1;
- the power of the reactor inlet furnace F-1 decreases by more than 30% relative to the reference device and process;
- the total power of the reactor inlet furnace F-1 and of the first air condenser A-1 decreases by 20% relative to the reference device and process; and
- the power of the first compression section K-1 decreases by 16% relative to the reference device and process.

Example 2

Figure 3:
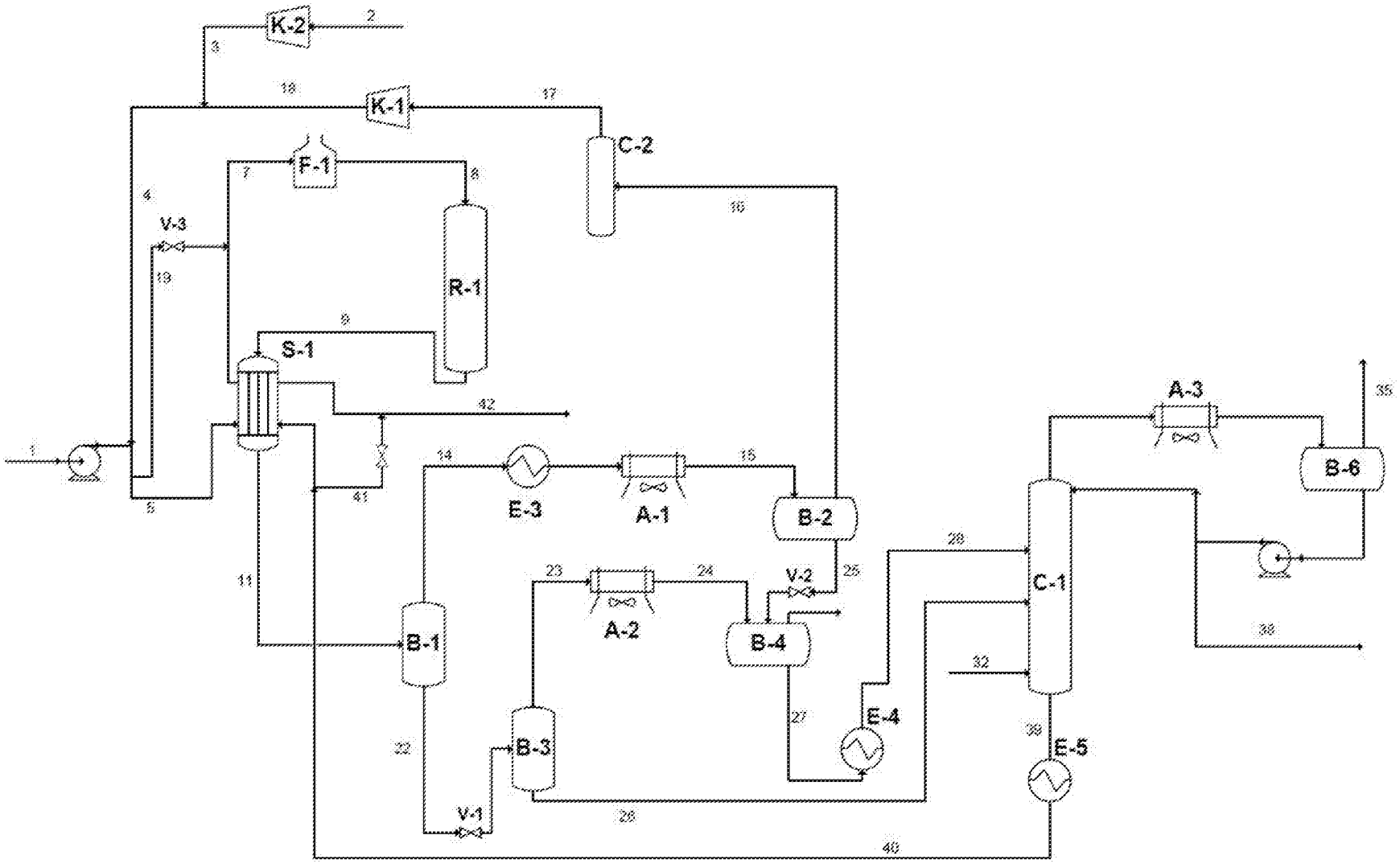
FIG. 3 depicts a layout of a device according to the present description in which the feedstock of the reaction section is preheated by the reaction effluent in a multiservice coil-wound heat exchanger S-1 then directly heated in a furnace before entering the reaction section.

FIG. 1 constitutes a reference comparison (comparison 1) and FIG. 3 describes a second example (Example 2) of an embodiment of the device and process according to the present description.

The hydrocarbon feedstock is a cut having boiling points between 250° C. and 620° C., having the following characteristics:

| | | |
|---|---|---|
| Specific gravity | | 0.950 |
| Sulfur content | % by weight | 3.5% |
| Nitrogen content | ppm by weight | 2400 |

According to the present description, as represented in FIG. 3, the hydrocarbon feedstock is fed via the line 1. The make-up hydrogen, preferably in excess relative to the hydrocarbon feedstock, is fed via the line 2 and the second compression section K-2 (e.g. compressor) then the line 3, and mixed with the recycled hydrogen in line 4. The hydrogen is then mixed with the hydrocarbon feedstock (line 1) before distributing the hydrocarbon mixture thus obtained to the coil-wound heat exchanger S-1 via the line 5. The coil-wound heat exchanger S-1 makes it possible to preheat the hydrocarbon mixture and also the bottoms liquid (line 39) from the separation column C-1, by means of the reaction effluent. In Example 2, the coil-wound heat exchanger S-1 is of multiservice type as described in patent application WO 2014/067223. After this heat exchange, the preheated hydrocarbon mixture is heated in the furnace F-1 via the line 7 then conveyed via the line 8 to a hydrodesulfurization section, comprising two hydrodesulfurization reactors (an example of a hydrotreatment or hydroconversion reaction section R-1) comprising at least one hydrodesulfurization catalyst. The temperature required for the hydrodesulfurization reaction may be adjusted by bypassing a portion of the hydrocarbon mixture via the line 19 (optionally by means of a valve V-3).

In this example, the hydrotreatment or hydroconversion reaction section R-1 is composed of two reactors with, respectively, 3 beds of Axens HRK 1448 catalyst (of NiMo on $Al_2O_3$ type) and 3 beds of Axens HYK 743 catalyst (of zeolite type). The beds of the reactors are operated approximately at 16.0 MPa and at temperatures between 375° C. and 406° C. The chemical hydrogen consumption in the reaction section is 2.8% by weight relative to the fresh hydrocarbon feedstock.

The reaction effluent is then sent to the exchanger S-1 via the line 9, then via the line 11 to the high-pressure hot separator B-1. The first gaseous effluent comprising a light fraction is separated in the high-pressure hot separator B-1 and recovered via the line 14. Said first gaseous effluent comprising a light fraction comprises unreacted hydrogen, $H_2S$ formed during the reaction, and also light hydrocarbons resulting from the conversion of the hydrocarbons of the hydrocarbon feedstock in the hydrotreatment reaction section. After cooling in the second exchanger E-3 and the first air condenser A-1 (line 14), the cooled and condensed first gaseous effluent comprising a light fraction is conveyed, via the line 15, to the high-pressure cold separator B-2 making it possible both to carry out a gas-liquid separation and a decantation of an aqueous liquid phase. The first liquid effluent comprising at least one light fraction resulting from the high-pressure cold separator B-2 feeds, after expansion in the valve or the liquid turbine V-2, the medium-pressure cold separator B-4 via the line 25.

The first liquid effluent comprising at least one heavy fraction recovered at the bottom of the high-pressure hot separator B-1 via the line 22 is, after expansion in the valve or the liquid turbine V-1, sent to the medium-pressure hot separator B-3 via the line 22. The second gaseous effluent comprising a light fraction is separated in the medium-pressure hot separator B-3 and recovered via the line 23. The second gaseous effluent comprising a light fraction comprises unreacted hydrogen, $H_2S$, and also generally light hydrocarbons resulting from the conversion of the hydrocarbons of the feedstock in the hydrotreatment reaction section. After passing through the second air condenser A-2, the condensed second gaseous effluent comprising a light fraction is conveyed, via the line 24, to the medium-pressure cold separator B-4. The second liquid effluent comprising at least one light fraction resulting from the medium-pressure cold separator B-4 feeds the third heat exchanger E-4 via the line 27 and the stripper (an example of a separation column C-1) via the line 28. The second liquid effluent comprising at least one heavy fraction resulting from the medium-pressure hot separator B-3 also feeds the stripper via the line 26.

The recycled hydrogen resulting from the high-pressure cold separator B-2 is sent via the line 16 to the amine washing column C-2 that makes it possible to eliminate at least one portion of the $H_2S$. The recycled hydrogen is then distributed via the lines 17 and 18 to the first mixing section then to the hydrodesulfurization reactor with the hydrocarbon feedstock, after compression by means of the first compression section K-1 and mixing with the feedstock (line 1).

The stripper is operated at 0.9 MPa at the top of the column, it is fed with stripping steam via the line 32. At the top of the stripper, the gaseous fraction of the overhead effluent is recovered (generally referred to as sour gas) via the line 35, and a naphtha-type cut is recovered via the line 38 that has a final boiling point usually greater than 100° C.

The bottoms liquid from the stripper, recovered via the line 39, is heated in the exchanger E-5 then in the multiservice coil-wound heat exchanger S-1 by the reaction effluent, then sent to an optional fractionating section via the line 42 in order to recover naphtha, kerosene and gas oil cuts and a residue. The inlet temperature of the fractionating section (not represented) is controlled by an additional bypass of the coil-wound heat exchanger S-1 suitable for directly distributing a portion of the bottoms liquid to the fractionating section via the line 41.

Table 2 compares:

- a reference hydrotreatment device and process using several trains of feedstock/effluent shell and tube heat exchangers E-1 of the TEMA BEU standard (FIG. 1); and
- a hydrotreatment device and process according to the present description using a single coil-wound heat exchanger S-1 (FIG. 3).

The reference process is operated with the same feedstock and the same operating conditions as those described above for Example 2.

TABLE 2

| | Comparison 2 (FIG. 1) | Example 2 (FIG. 3) |
|---|---|---|
| Temperature (° C.) of the hydrocarbon mixture at the inlet of E-1/S-1 (Line 5) | 209 | 209 |
| Temperature (° C.) of the hydrocarbon mixture at the inlet of the furnace F-1 (Line 7) | 328 | 328 |
| Temperature (° C.) of the bottoms liquid at the outlet of E-5 (Line 40) | 226 | 226 |
| Temperature (° C.) of the bottoms liquid at the outlet of the device (Line 42) | — | 326 |
| Temperature (° C.) of the reaction effluent at the inlet of E-1/S-1 (Line 9) | 402 | 402 |
| Temperature (° C.) of the reaction effluent at the outlet of E-1/S-1 (Line 11) | 250 | 250 |
| Power (MW) of the reactor inlet furnace F-1 | 26.8 | 26.5 |
| Power (MW) of the first air condenser A-1 | 49.7 | 48.1 |
| Power (MW) of the first compression section K-1 | 8.1 | 6.3 |

The use of a multiservice coil-wound heat exchanger S-1 makes it possible, in addition to reducing the number of exchangers, to observe an energy-saving owing to a reduction in the powers of the reactor inlet furnace, of the compressor K-1 and of the air condenser A-1.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A device suitable for hydroconversion or hydrotreatment of a hydrocarbon feedstock, comprising:

a single coil-wound heat exchanger (S-1), said coil-wound exchanger being a single-pass heat exchanger formed by a vertical chamber in which one or more bundles of tubes are helically wound around a central core, as numerous superposed layers, suitable for: preheating and directly distributing the hydrocarbon feedstock and optionally a hydrogen stream or a hydrocarbon feedstock/hydrogen stream mixture to a reactor inlet furnace (F-1) of a hydrotreatment or hydroconversion reaction section (R-1), and cooling reaction effluent from the hydrotreatment or hydroconversion reaction section (R-1); the reactor inlet furnace (F-1) for heating and distributing the preheated hydrocarbon feedstock/hydrogen stream mixture to the hydrotreatment or hydroconversion reaction section (R-1); the hydrotreatment or hydroconversion reaction section (R-1) suitable for hydrotreating or hydroconverting the hydrocarbon feedstock; a high-pressure cold separator (B-2) suitable for separating at least one portion of cooled reaction effluent into a first liquid effluent comprising at least one light fraction and a first gaseous effluent comprising hydrogen; and a separation column (C-1) suitable for separating the first liquid effluent comprising at least one light fraction into a bottoms liquid and an overhead effluent and further comprising a first bypass (19) suitable for directly distributing a portion of the hydrocarbon feedstock or a portion of the hydrocarbon feedstock/hydrogen stream mixture from the inlet of the coil-wound heat exchanger (S-1) to the outlet of the coil-wound heat exchanger (S-1).

2. The hydroconversion or hydrotreatment device according to claim 1, in which the coil-wound heat exchanger (S-1) is a multiservice coil-wound heat exchanger.

3. The hydroconversion or hydrotreatment device according to claim 2, in which the multiservice coil-wound heat exchanger is suitable for heating at least one portion of the bottoms liquid from the separation column.

4. The hydroconversion or hydrotreatment device according to claim 3, further comprising a second bypass (41) of the multiservice coil-wound heat exchanger suitable for controlling the temperature of the bottoms liquid at the outlet of the multiservice coil-wound heat exchanger.

5. The hydroconversion or hydrotreatment device according to claim 1, further comprising a high-pressure hot separator (B-1) suitable for separating the cooled reaction effluent into a first liquid effluent comprising at least one heavy fraction and a first gaseous effluent comprising a light fraction distributed to the high-pressure cold separator (B-2).

6. The hydroconversion or hydrotreatment device according to claim 5, further comprising a medium-pressure hot separator (B-3) suitable for separating the first liquid effluent comprising at least one heavy fraction into a second liquid effluent comprising at least one heavy fraction distributed to the separation column (C-1), and a second gaseous effluent comprising a light fraction.

7. The hydroconversion or hydrotreatment device according to claim 1, further comprising a medium-pressure cold separator (B-4) suitable for separating prior to (C-1), the first liquid effluent comprising at least one light fraction into a second liquid effluent comprising at least one light fraction distributed to the separation column (C-1) in place of said first liquid effluent, and a second gaseous effluent comprising hydrogen.

8. The hydroconversion or hydrotreatment device according to claim 7, further comprising a high-pressure hot separator (B-1) suitable for separating the cooled reaction effluent into a first liquid effluent comprising at least one heavy fraction and a first gaseous effluent comprising a light fraction distributed to the high-pressure cold separator (B-2) in which the medium-pressure cold separator (B-4) is suitable for separating the second gaseous effluent comprising a light fraction.

9. A process comprising hydroconversion or hydrotreatment of a hydrocarbon feedstock, comprising:

preheating and directly distributing a portion of the hydrocarbon feedstock and optionally a hydrogen stream or a hydrocarbon feedstock/hydrogen stream mixture to a reactor inlet furnace (F-1) of a hydrotreatment or hydroconversion reaction section (R-1) by a single coil-wound heat exchanger (S-1);

directly distributing via a bypass a portion of the hydrocarbon feedstock or a portion of the hydrocarbon feedstock/hydrogen stream mixture from the inlet of the coil-wound heat exchanger (S-1) to the outlet of the coil-wound heat exchanger (S-1);

mixing the hydrocarbon feedstock with the hydrogen stream, said mixing taking place before or after preheating;

cooling reaction effluent from the hydrotreatment or hydroconversion reaction section (R-1) by means of the coil-wound heat exchanger (S-1), said coil-wound exchanger being a single-pass heat exchanger formed by a vertical chamber in which one or more bundles of tubes are helically wound around a central core, as numerous superposed layers;

heating and distributing preheated hydrocarbon feedstock/hydrogen stream mixture to the hydrotreatment or hydroconversion reaction section (R-1) by means of the reactor inlet furnace (F-1);

hydrotreating or hydroconverting the hydrocarbon feedstock in the hydrotreatment or hydroconversion reaction section (R-1) comprising at least one reactor comprising at least one catalyst comprising at least one element of Group VIII of the Periodic Table;

separating at least one portion of the cooled reaction effluent in a high-pressure cold separator (B-2) in order to distribute a first liquid effluent comprising at least one light fraction and a first gaseous effluent comprising hydrogen; and separating the first liquid effluent comprising at least one light fraction in a separation column (C-1) in order to distribute a bottoms liquid and an overhead effluent.

10. The hydroconversion or hydrotreatment process according to claim 9, in which the hydrotreatment or hydroconversion of the hydrocarbon feedstock is carried out with at least one of the following operating conditions:

the temperature is between around 200° C. and around 460° C.;

the total pressure is between around 1 MPa and around 20 MPa;

the overall hourly space velocity of liquid feedstock is between around 0.05 $h^{-1}$ and around 12 $h^{-1}$;

the hydrogen stream comprises between around 50 vol % and around 100 vol % of hydrogen relative to the volume of the hydrogen stream;

the amount of hydrogen relative to the liquid hydrocarbon feedstock is between around 50 $Nm^3/m^3$ and around 2500 $Nm^3/m^3$.

11. The hydroconversion or hydrotreatment process according to claim 9, in which the hydrocarbon feedstock comprises an initial point of greater than 120° C.

12. The hydroconversion or hydrotreatment process according to claim 9, in which the high-pressure cold separator (B-2) is operated at a pressure below the pressure of the hydrotreatment or hydroconversion reaction section (R-1) and/or in which the temperature of the high-pressure cold separator (B-2) is between 20° C. and 100° C.

13. A process for hydroconversion or hydrotreatment of a hydrocarbon feedstock, comprising subjecting said hydrocarbon feedstock to hydroconversion or hydrotreatment conditions in a coil-wound heat exchanger (S-1), said coil-wound exchanger being a single-pass heat exchanger formed by a vertical chamber in which one or more bundles of tubes are helically wound around a central core, as numerous superposed layers and having a bypass suitable for directly distributing a portion of the hydrocarbon feedstock from the inlet of the coil-wound heat exchanger (S-1) to the outlet of the coil-wound heat exchanger (S-1).

14. The process according to claim 13, in which the coil-wound heat exchanger (S-1) is used for:

preheating and directly distributing a hydrocarbon feedstock/hydrogen stream mixture to a reactor inlet furnace (F-1) of a hydrotreatment or hydroconversion reaction section (R-1);

and cooling the effluent from the hydrotreatment or hydroconversion reaction section (R1).

* * * * *